US007264242B2

(12) United States Patent
Hooper et al.

(10) Patent No.: US 7,264,242 B2
(45) Date of Patent: Sep. 4, 2007

(54) LIGHT-REFLECTING BOARD GAME

(75) Inventors: Luke Jackson Hooper, Norman, OK (US); Del Alan Segura, Denham Springs, LA (US); Michael Charles Larson, New Orleans, LA (US)

(73) Assignee: Innovention Toys, L.L.C., Denham Springs, LA (US)

( * ) Notice: Subject to any disclaimer, the term of this patent is extended or adjusted under 35 U.S.C. 154(b) by 0 days.

(21) Appl. No.: 11/353,863

(22) Filed: Feb. 13, 2006

(65) Prior Publication Data

US 2006/0226602 A1 Oct. 12, 2006

Related U.S. Application Data

(60) Provisional application No. 60/652,533, filed on Feb. 14, 2005, provisional application No. 60/679,821, filed on May 11, 2005.

(51) Int. Cl.
*A63F 3/00* (2006.01)

(52) U.S. Cl. ..... 273/238; 273/237; 273/460

(58) Field of Classification Search ..... 273/275, 273/288, 289, 290–291, 236–237, 459–460, 273/339, 364, 284
See application file for complete search history.

(56) References Cited

U.S. PATENT DOCUMENTS 3,516,671 A 6/1970 Estrin
4,017,072 A 4/1977 Kurtz
4,182,514 A 1/1980 Magid et al.
4,376,538 A 3/1983 Keenan
5,145,182 A * 9/1992 Swift et al. ..... 273/238
6,488,583 B1 12/2002 Jones et al.
2004/0080107 A1* 4/2004 Triplette ..... 273/237

* cited by examiner

*Primary Examiner*—Robert E. Pezzuto
*Assistant Examiner*—Alex F. R. P. Rada, II
(74) *Attorney, Agent, or Firm*—Lowrie, Lando & Anastasi, LLP

(57) ABSTRACT

A board-type game to be played by two or more players. The game includes lasers where players selectively divert the path of the laser beams. The board apparatus comprises a surface, bounded by a frame, over which laser beams are directed down symbolic rows and columns which constitute a matrix of squares. Each square is a subregion of the surface piece, and is bounded along its four sides by raised edges which are parallel and perpendicular rows and columns of the board. The raised edges, creating recessed squares, assist in orienting the playing pieces. Playing pieces may contain no mirror, one mirror, or two mirrors (oriented back-to-back to produce separate surfaces reflecting in opposite directions). Playing pieces are placed in a predetermined "starting" configuration on the squares of the gridded surface piece. Depending on whether a playing piece contains a mirror or not, said piece may reflect an incident laser beam from a row to a column or from a column to a row. A laser is placed in a predetermined position, in front of each player. The players alternate in moving pieces from square to square or rotating pieces in place, on the gridded surface, with the object of either directing their laser beam toward the opponent's "key" piece or preventing their opponent's laser beam from reaching their own "key" piece.

54 Claims, 16 Drawing Sheets

LIGHT-REFLECTING BOARD GAME

CROSS REFERENCES TO RELATED APPLICATIONS

U.S. Provisional Patent Application No. 60/652,533, filed 14 Feb. 2005, and U.S. Provisional Patent Application No. 60/679,821, filed 11 May 2005, are incorporated herein by reference. Priority of those applications is hereby claimed.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates to board type games played on a game board or surface, preferably a substantially orthogonally gridded, planar surface, and more particularly to a game which selectively diverts a beam (e.g. laser beam) by user-placed mirrored game pieces that are moved laterally or rotated during play.

2. Description of the Related Art

Many board games have been provided which use paths across their surface as part of the game. An example of such a game is chess. In addition, games exist that depend on the deflection or reflection of objects off of other objects to "score" points.

The following US Patents are examples of board games, each hereby incorporated herein by reference: U.S. Pat. Nos. 3,516,671; 5,145,182; and 6,702,286.

U.S. Pat. No. 3,516,671 (the '671 patent) describes a board game that combines the features of the players creating paths and deflection of the paths. The '671 patent shows a board game, having a matrix comprised of rows and columns, and an energy source, which is electricity in the preferred embodiment, that can be selectively positioned to direct energy along a selected column, thereby creating an energy path. The energy path may be diverted to a row and then back to a column by deflecting pieces. The deflecting pieces may be small mirrors. However, the '671 patent does not contemplate a plurality of styles for pieces, directing energy toward a mobile game piece of an opponent, nor the unique elements and rules of the instant invention.

U.S. Pat. No. 5,145,182 (the '182 patent) describes a board game that combines the features of the players creating paths with laser beams and deflection of the laser beam paths. The '182 patent shows a board game, having a matrix comprised of rows and columns, multiple laser beams that can be selectively directed along a selected row or column, thereby creating a laser beam path. The energy path may be diverted to a row and then back to a column by selectively-placed deflecting pieces. The deflecting pieces may be small mirrors. The object of each player is to direct their laser beams toward the opponent's light-detecting scoring module while preventing the opponent's laser beams from reaching their own scoring module. The '182 patent does not contemplate providing a separate single beam for each player, instead of multiple lasers per player. The '182 patent also does not contemplate a game played without a light-detecting scoring module. Importantly, the '182 patent does not describe a game wherein players begin the game with playing pieces placed in a predetermined "starting" configuration on the playing surface, or wherein players take turns moving said pieces on the surface to change their position or orientation; instead, the '182 patent contemplates turn-by-turn addition of playing pieces to the game board.

U.S. Pat. No. 6,702,286 (the '286 patent) describes a war strategy board game that combines the features of player-initiated playing piece movement with illumination of the playing grid. The '286 patent describes illumination of radial and latitudinal paths adjacent to playing pieces, said illumination provided by electric circuitry and lights. The stated purpose for illumination is to help players know when two pieces are flanking (thus surrounding, and capturing) an opposing piece. The '286 patent does not contemplate using a beam to illuminate playing pieces or mirrors to deflect light and thereby illuminate playing pieces. The '286 patent contemplates a game in which the object is to maneuver one's pieces to flank (or surround) those of the opposing player.

Strategy games may differ in a variety of ways. For example, the boards may contain different layouts or fields of positions. Each player may have the same or a different number of playing pieces. Each player may have the same or different kinds of playing pieces with superior strengths or capabilities. Playing pieces may be placed on the board at the start of the game or throughout the game. The playing pieces may move in a wide variety of ways on their respective boards. Players may capture the opposing pieces by moving their pieces to jump, surround, occupy the same position as, or otherwise affect the opposing pieces. Some games are limited to two players, while others allow two or more players. Each of these variations affects the strategy of play and the degree of skill required to play the game against a knowledgeable opponent.

Game designs should produce a balance between opposing players or sides. Neither player should have a significant advantage over the other simply based on which side or set of pieces they are playing, or who moves first. The combination of board size and geometry, the types and number of playing pieces, the layout of the interconnecting playable positions, the manner each piece moves on the board, the manner of capture and the number of allowable players should all be taken into consideration when designing a strategy game.

Game designs should involve a desired degree of skill and variation of possible moves and outcomes. They should reward strategy and thought. If the board layout, types and number of pieces, rules of movements, rules of capture and criterion for completion are overly simplistic, the game is too easy, will usually end in a draw or a predictable manner, and quickly become uninteresting for the average player. An example is "tic-tac-toe," which (although often played with pen and paper, could also be played on a board) usually ends in a draw. Conversely, if the board size and layout, number and kinds of pieces, and rules of movement and capture are overly complicated, the game takes too long to learn is frustrating and uninteresting for the average player.

BRIEF SUMMARY OF THE INVENTION

The present invention is a game that employs a game board or playing surface, over which beams (e.g. laser beams) are directed in one embodiment down symbolic rows and columns that constitute a matrix of squares (each square being formed at the intersections of said rows and columns), and game playing pieces, some possessing surfaces which reflect the said laser beams.

The present invention combines the strategy of traditional board games with modern technology, for an engaging experience. The rules are simple enough to be learned in minutes, but the options during play are plentiful enough so as to be neither dull nor predictable.

The game of the present invention has the universal and enduring appeal of classic games, such as chess, checkers and go, in an embodiment which incorporates lasers.

The game of the present invention generates a "beam" for each player, which can be a low-powered laser diodes to emit a beam of colored light. These beams are reflected and deflected around the playing field by mirrored surfaces of pieces, or stopped by non-mirrored surfaces of pieces.

The game is won by a player who strategically maneuvers pieces to reflect a laser beam so as to illuminate a key piece belonging to his opponent, e.g., a "Pharaoh" or "King" piece.

With each turn, a player may move one of his pieces to one of the potentially eight, unoccupied adjacent squares (front, back, left, right or diagonal) or may rotate (re-orient) one of his pieces.

After moving or rotating a piece, that player presses a fire button that triggers the emission of a beam above and parallel to the playing surface. If the beam hits a non-mirrored surface of a playing piece, that piece is removed from the board and eliminated from further play, unless it is the key piece, e.g., "King" or "Pharaoh" piece, in which case the game ends.

The pieces can vary in design and setup, with mirrors being located on multiple (e.g. one, two or more) sides or no sides.

BRIEF DESCRIPTION OF THE SEVERAL VIEWS OF THE DRAWINGS

For a further understanding of the nature, objects, and advantages of the present invention, reference should be had to the following detailed description, read in conjunction with the following representative drawings, wherein like reference numerals denote like elements and wherein.

DETAILED DESCRIPTION OF THE PREFERRED EMBODIMENT

Figure 1:
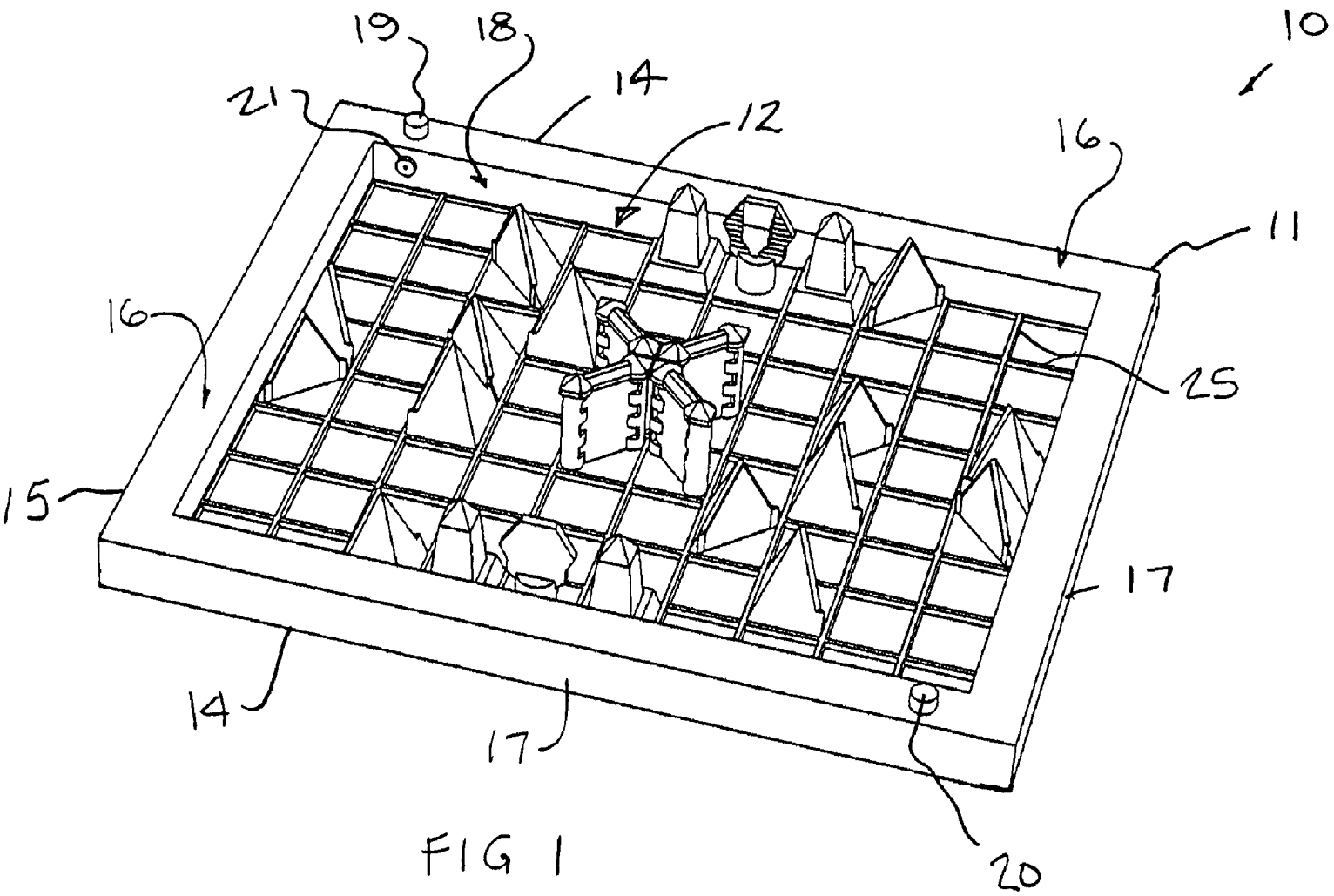
FIG. 1 is a perspective view of the preferred embodiment of the apparatus of the present invention.

FIGS. 1-4 show the laser game board apparatus of the present invention, designated generally by the numeral 10. Laser game board apparatus 10 provides a game board 11 having an upper playing surface 12 and a lower surface 13. Board 11 has a periphery 14. Raised border 15 is positioned at periphery 14.

The raised border 15 includes a plurality of sections or flanges that can be flat or planar as shown. The raised sections includes horizontal section 16, outer vertical section 17, and inner vertical section 18. A playing area 23 is defined by a plurality of smaller areas or squares that can be recessed areas 23A, each preferably being square in shape.

Figure 2:
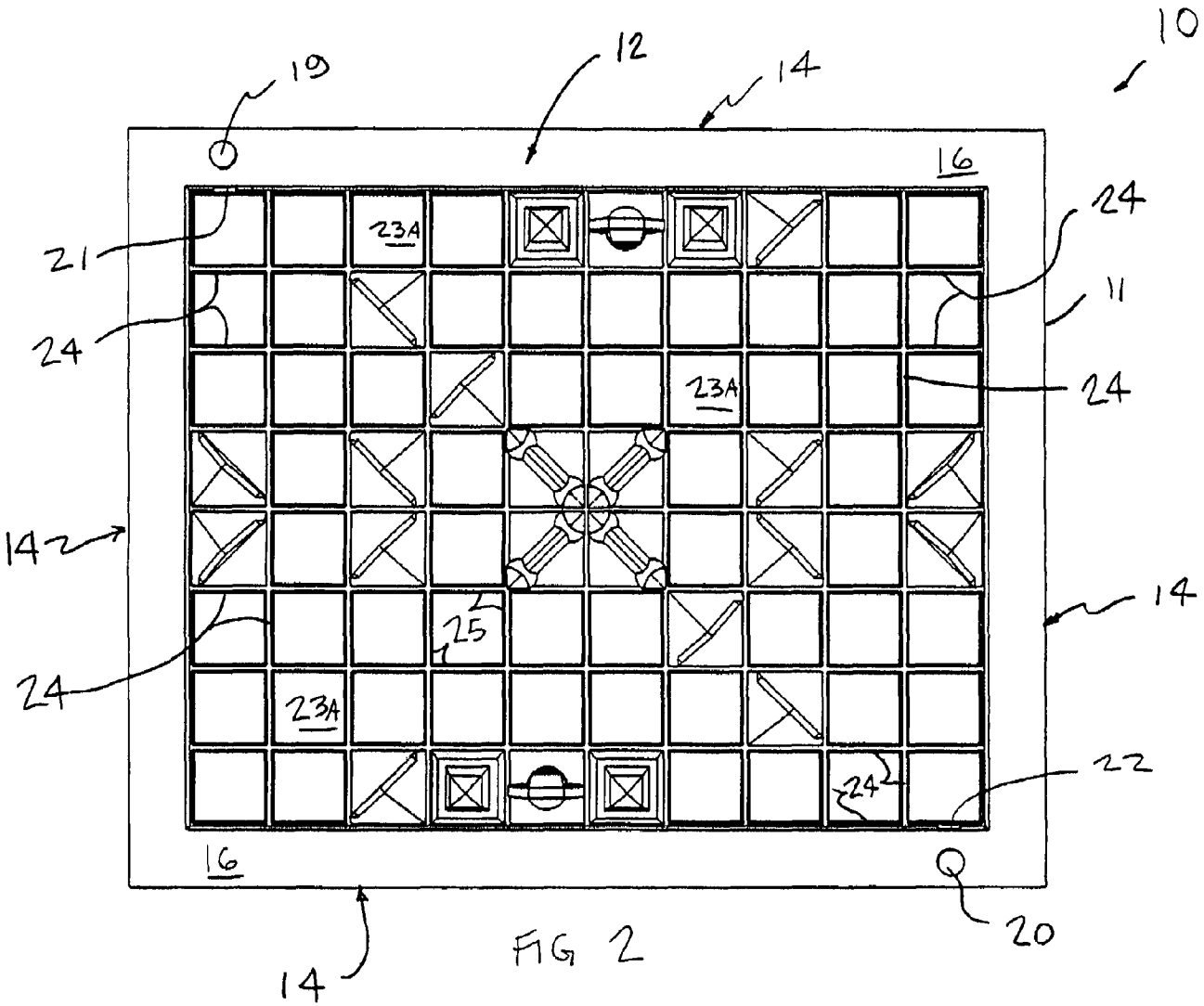
FIG. 2 is a plan view of the preferred embodiment of the apparatus of the present invention.
Figure 3:
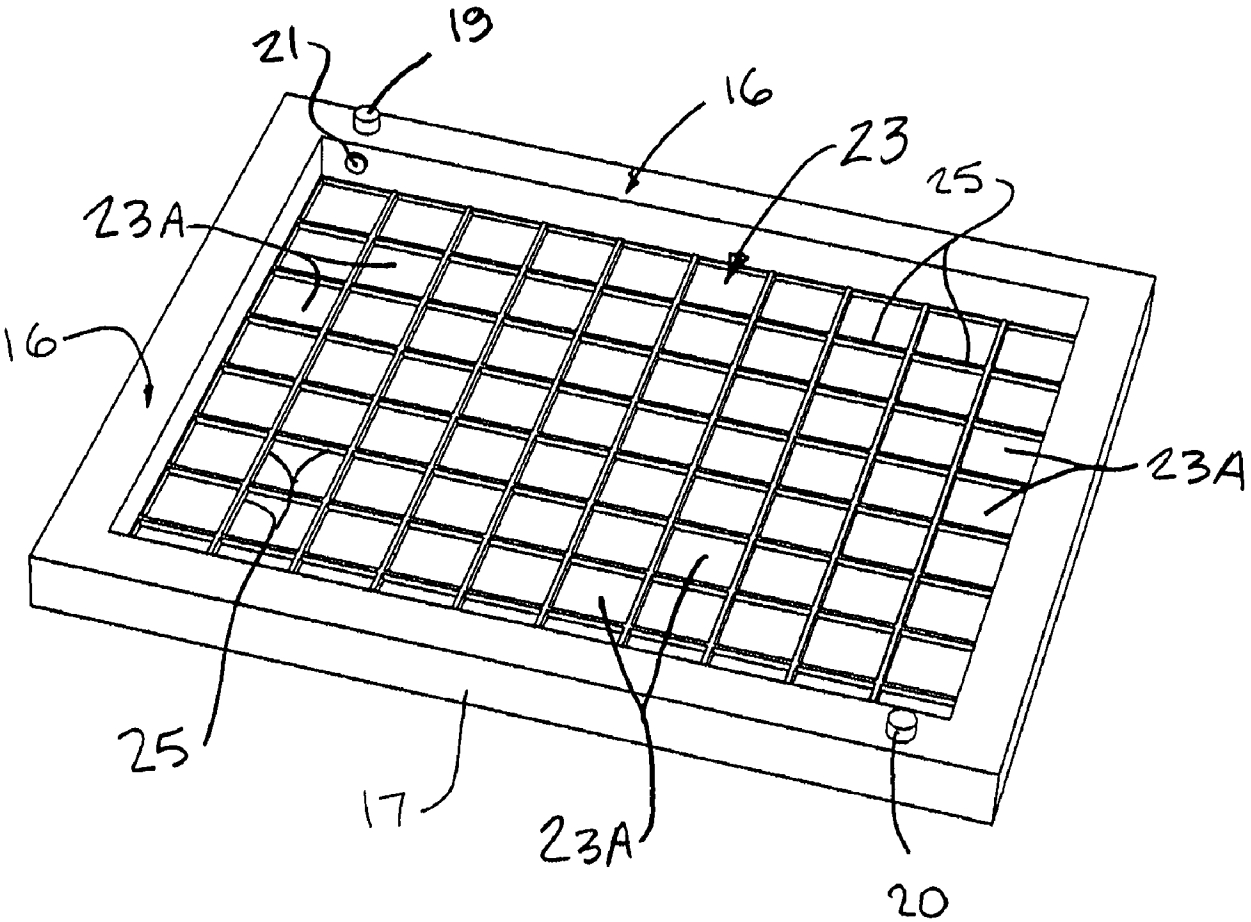
FIG. 3 is a partial perspective view of the preferred embodiment of the apparatus of the present invention showing the game board with game pieces removed.
Figure 4:
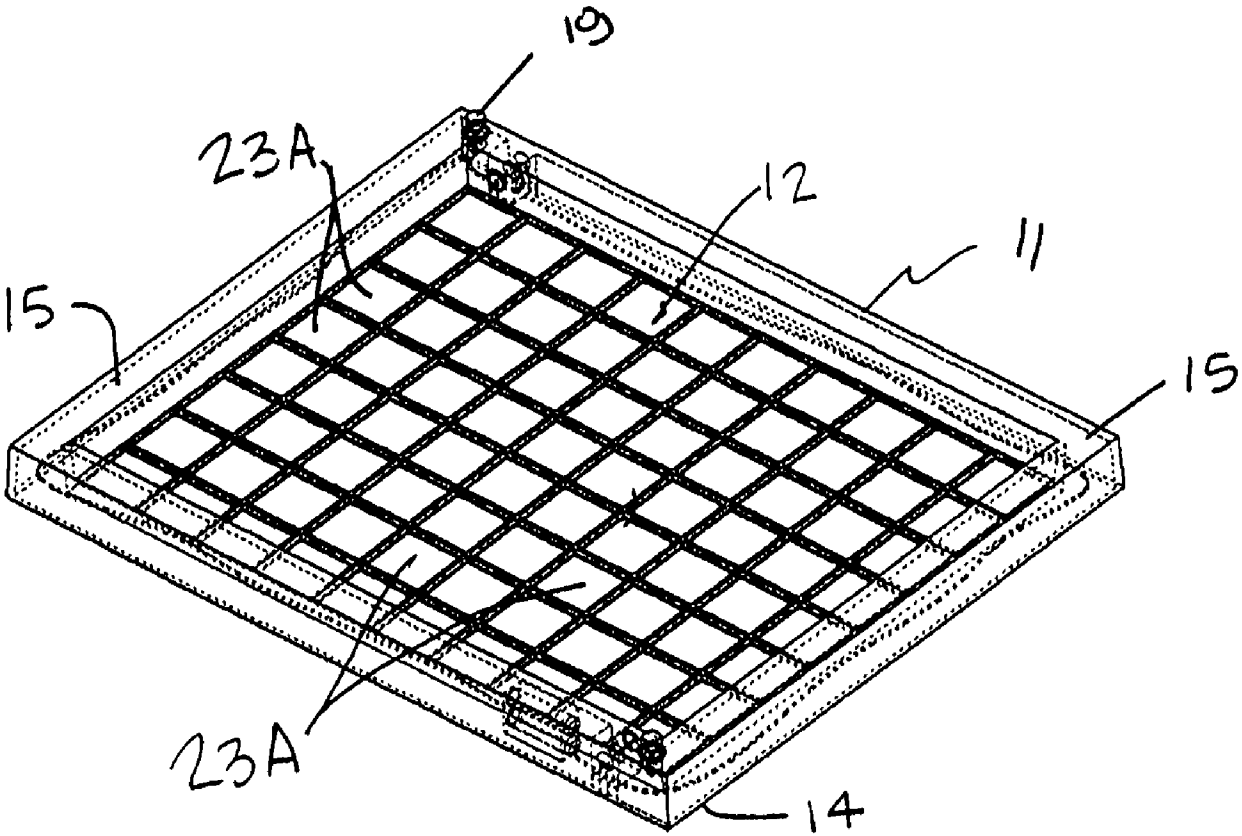
FIG. 4 is a partial perspective view of the preferred embodiment of the apparatus of the present invention showing the game board with no playing pieces and illustrating hidden electrical components and wiring.

There are a pair of laser activating buttons 19, 20 positioned at opposing sides of game board 11 as shown in FIGS. 1-2. Each of the laser activating buttons 19, 20 activates a laser. Each of two players has control of a button 19 or 20 during a game. The laser activating button 19 activates laser 21 for a first player. The laser activating button 20 operates laser 22 for a second player.

Each of the recessed square areas 23A is surrounded by a raised border 25 that can be square in shape as shown. The raised border 25 can be comprised of a plurality of raised elements 24.

Figure 5:
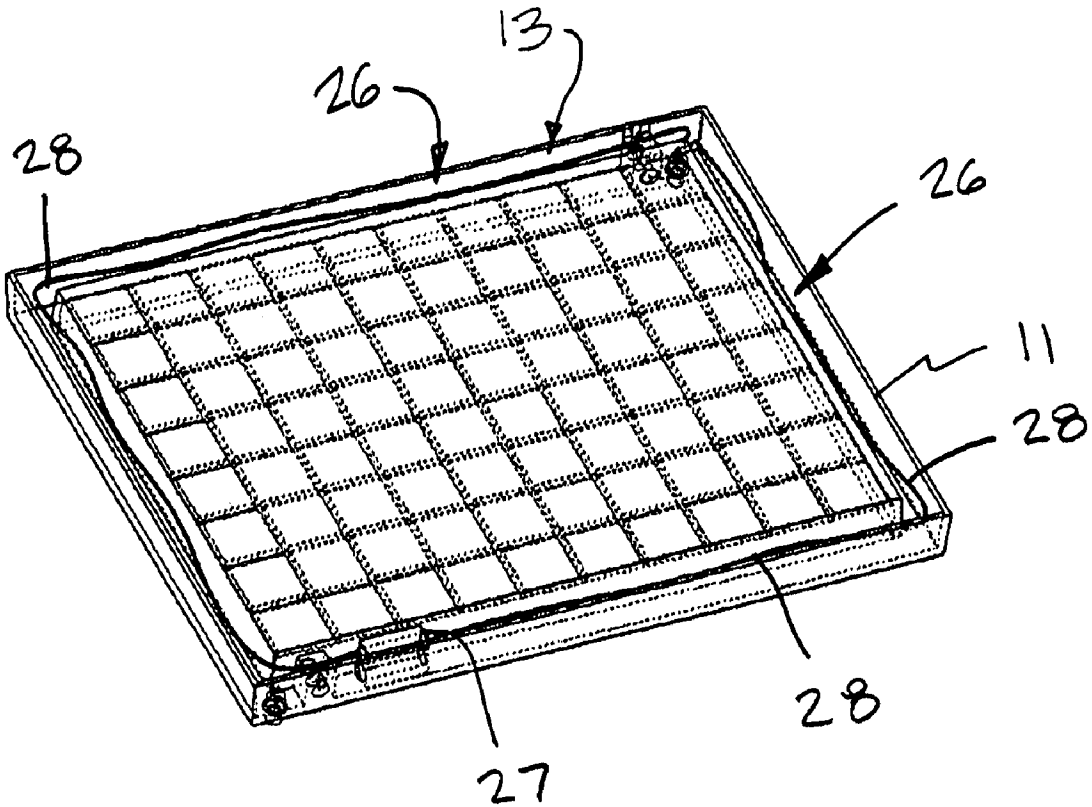
FIG. 5 is a bottom perspective view of the preferred embodiment of the apparatus of the present invention showing electrical game board components.

In the bottom peripheral view of FIG. 5, lower section 13 of game board 11 reveals cavity 26 that is defined by the sections 16, 17, 18 of raised border 15. Cavity 26 provides one or more battery compartments 27. The cavity 26 can be used for containing wiring 28 that interconnects a battery (or batteries) and lasers 21, 22 so that power supplied by a battery that occupies battery compartment 27 can be used to power the lasers 21, 22.

During play, a beam 29 is selectively emitted by each laser 21, 22 when activated by a player's control button 19 or 20. The laser beam 29 that is emitted by a laser 21 or 22 provides a visible indication of whether or not a particular game piece 30, 35, 40, 50 has been hit by the beam 29. An illumination appears on the particular game piece 30, 35, 40, 50 such as for example a red or orange circular illumination or dot. However, some of the game pieces (40, 50) provide mirrored surfaces so that while the beam strikes the mirrored surface 45 or 55 or 56 of that particular game piece, it is also reflected toward another game piece 30, 35, 40, 50.

Figure 7:
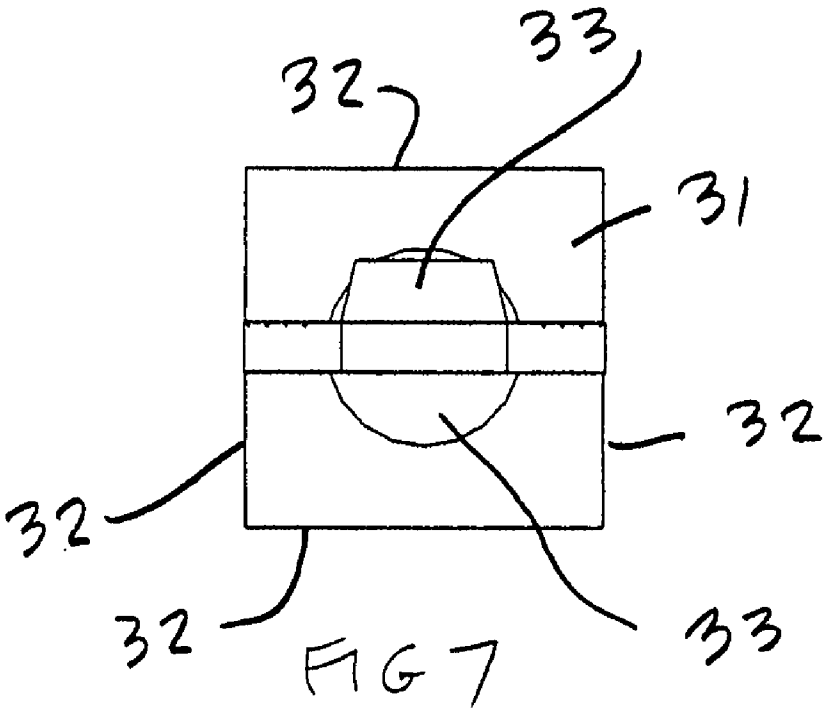
FIG. 7 is a top view of the game piece of FIG. 6.
Figure 6:
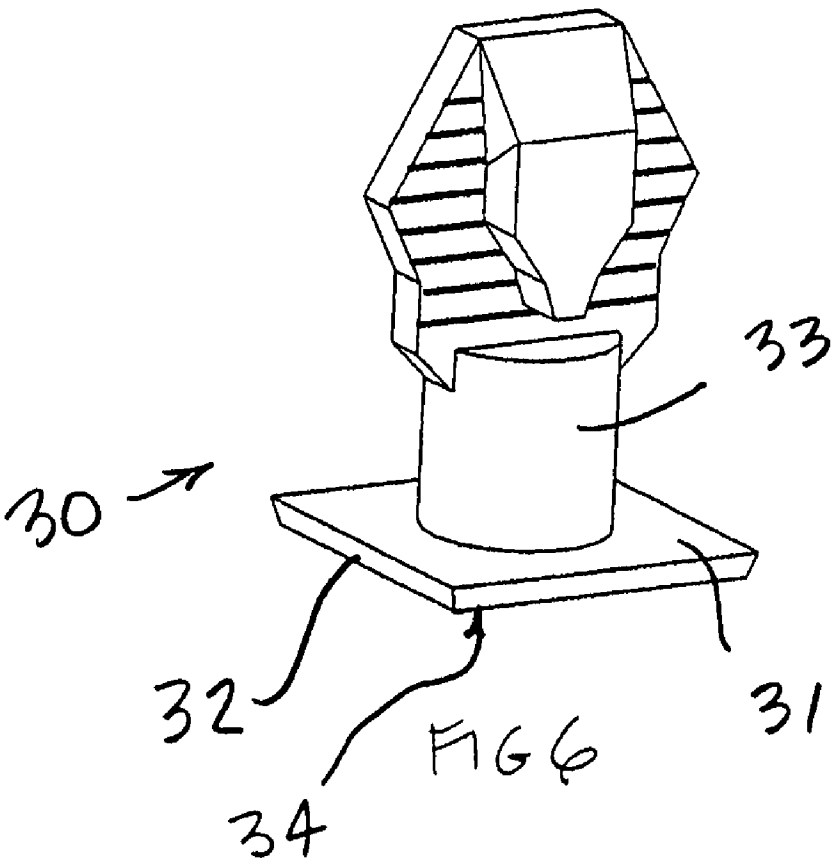
FIG. 6 is a perspective view of one of the game pieces, a "key" game piece in the form of a Pharaoh playing piece having no mirrored surfaces.

In FIGS. 6 and 7, the game piece 30 is the key game piece, namely that game piece that ends the game when it is hit with beam 29. Game piece 30 provides a base 31 having a periphery 32. Vertically extending portion 33 of game piece 30 extends upwardly from base 34. In the embodiment shown in FIGS. 6 and 7, the game piece 30 is in the form of a Pharaoh. However, other forms can be used for key game piece 30 (e.g. King, Queen, etc.).

Figure 9:
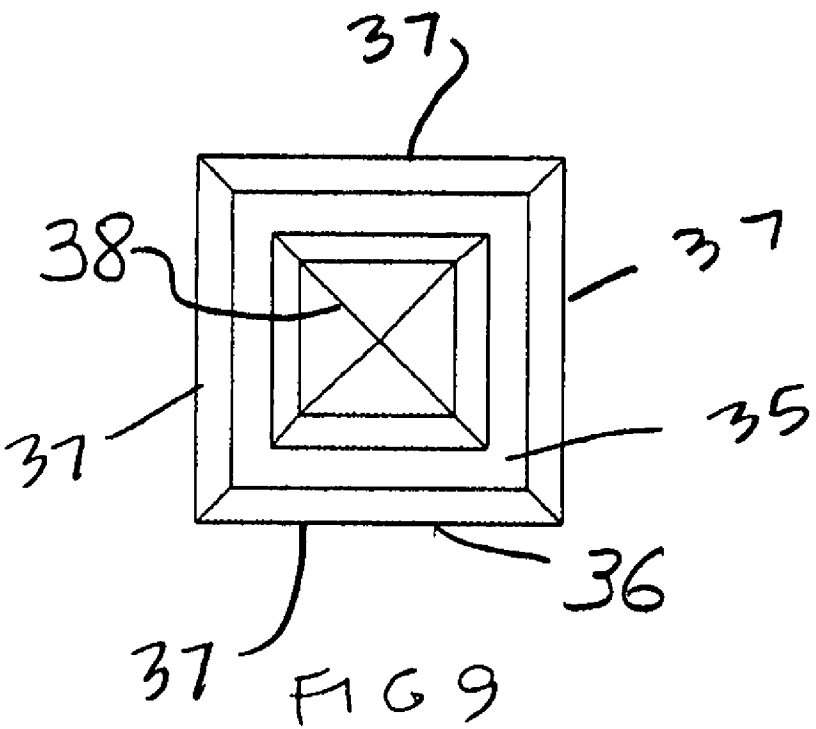
FIG. 9 is a top view of the game piece of FIG. 8.
Figure 8:
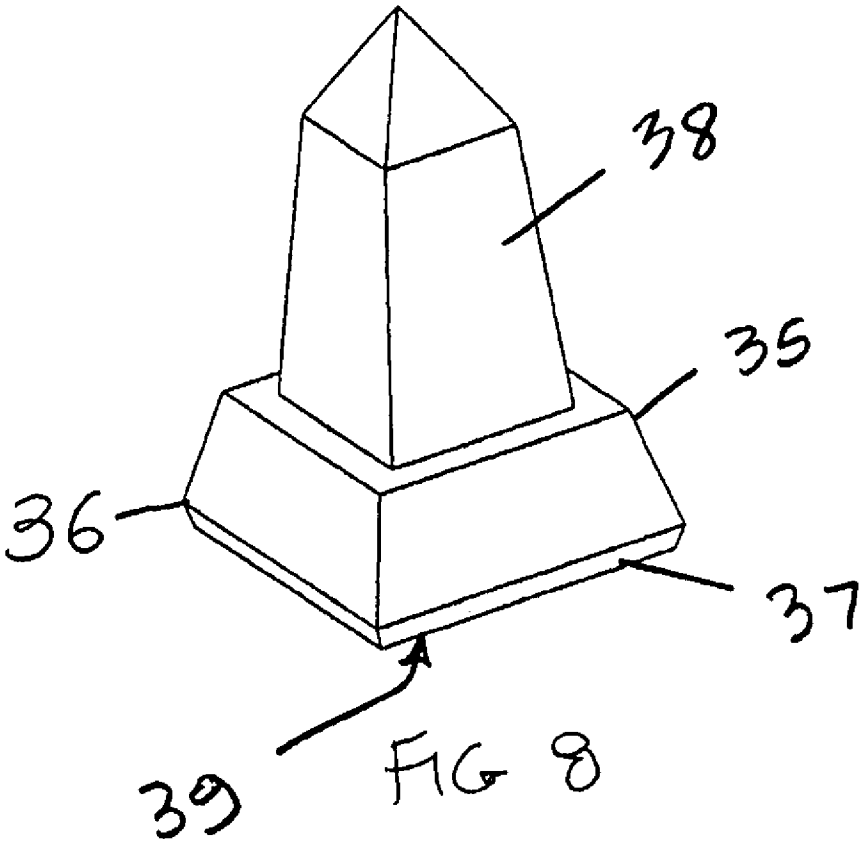
FIG. 8 is a perspective view of one of the game pieces in the form of an Obelisk playing piece having no mirrored surfaces.

In FIGS. 8 and 9, another game piece 30 is shown, in the form of an Obelisk. Game piece 35 has a base 36 with a periphery 37. Vertically extending portion 38 extends upwardly from base 36. Game piece 35 also provides a generally flat or planar underside 39. Each of the game pieces 35, 40 is non-mirrored so that if either is struck by a laser beam 29, it is removed from the game board playing area 23.

Figure 12:
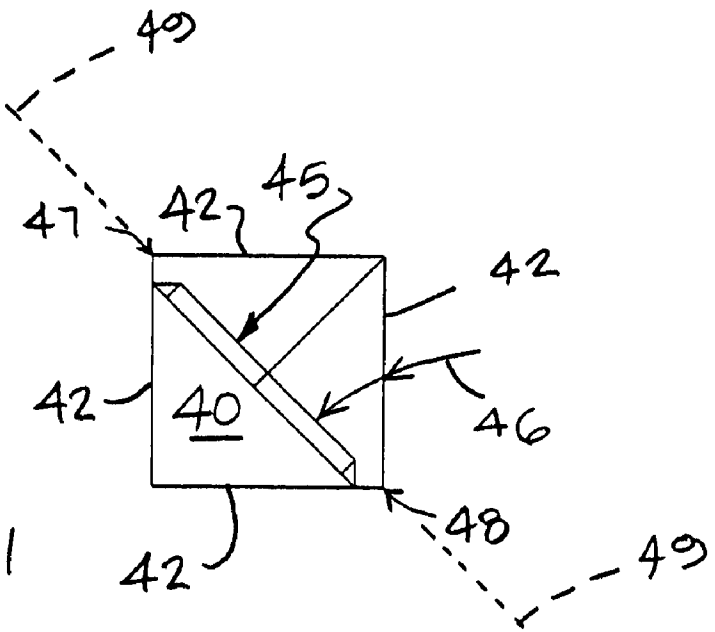
FIG. 12 is a top view of the game piece of FIGS. 10-11.
Figure 11:
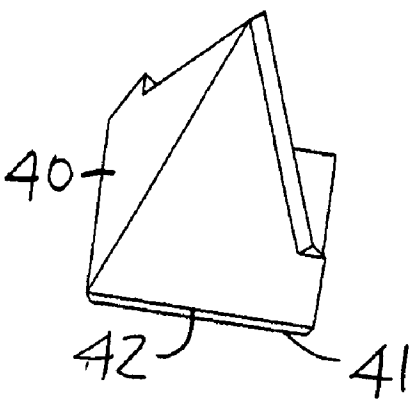
FIG. 11 is a perspective view of the game piece of FIG. 10 in the form of a Pyramid playing piece having one mirrored surface.
Figure 10:
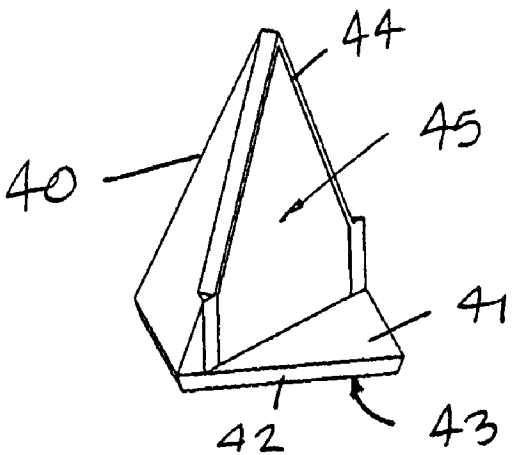
FIG. 10 is a perspective view of one of the game pieces in the form of a Pyramid playing piece having one mirrored surface.

The game piece 40 shown in FIGS. 10-12 has a base 41 with a periphery 42. The base 41 provides a flat or planar underside 43. A vertically extending portion 44 extends upwardly from base 41. The vertically extending portion 44 provides a mirrored surface 45. As shown in FIG. 12, the mirrored surface 45 forms an angle 46 of about 45 degrees with the sides of base 41 at periphery 42. Thus, the mirrored surface 45 falls upon a reference line 49 that extends from corner 47 to corner 48. When a laser beam 29 strikes mirrored surface 45, it will turn 90 degrees as will be illustrated more fully hereinafter.

Figure 14:
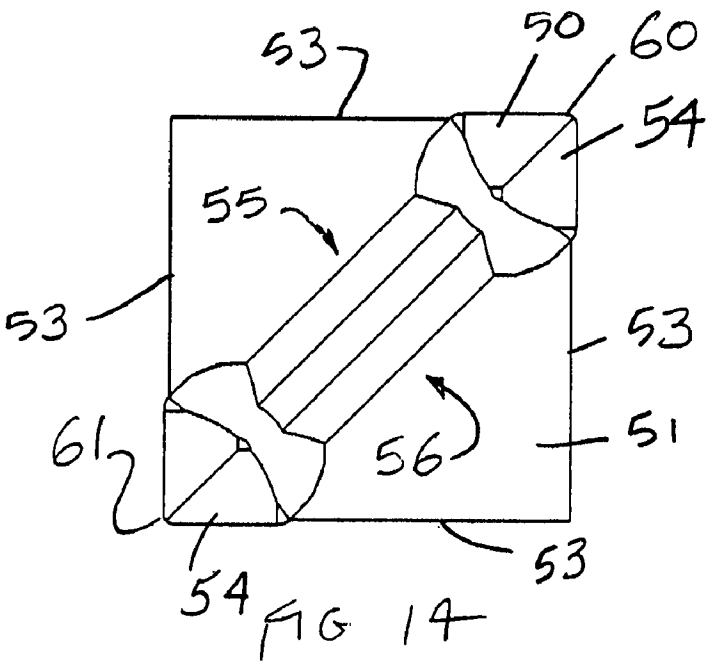
FIG. 14 is a top view of the game piece of FIG. 13.
Figure 13:
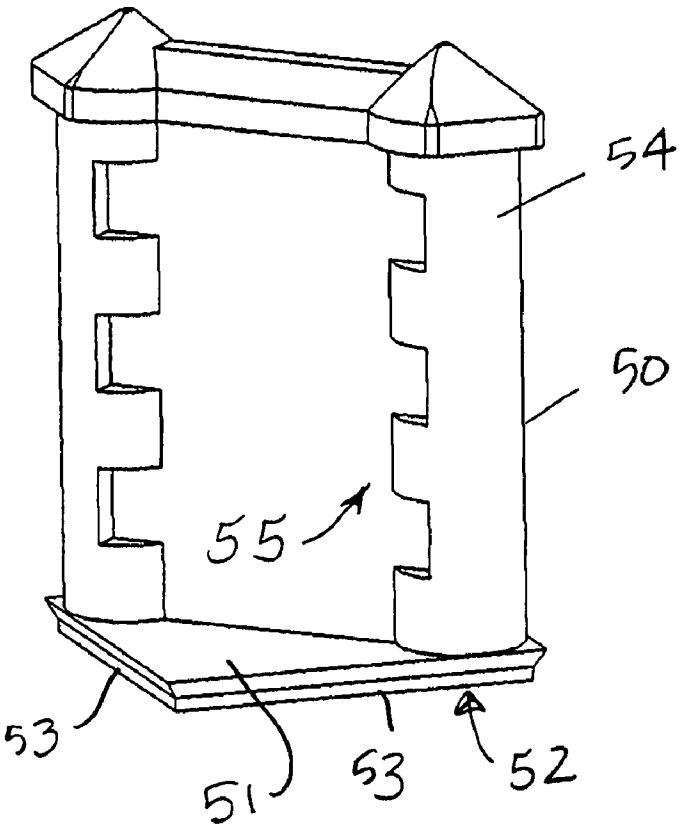
FIG. 13 is a perspective view of one of the game pieces in the form of a Djed Column playing piece having multiple mirrored surfaces.

The game piece 50 is also a mirrored game piece. Game piece 50 provides a base 51 having an underside 52 and a periphery 53. The underside 52 is preferably flat or planar. A vertically extended portion 54 of game piece 50 provides a pair of mirrored surfaces 55, 56 as shown in FIGS. 13 and 14. Each of the mirrored surfaces 55, 56 forms an angle of about 45 degrees with any side of periphery 53.

Figure 15:
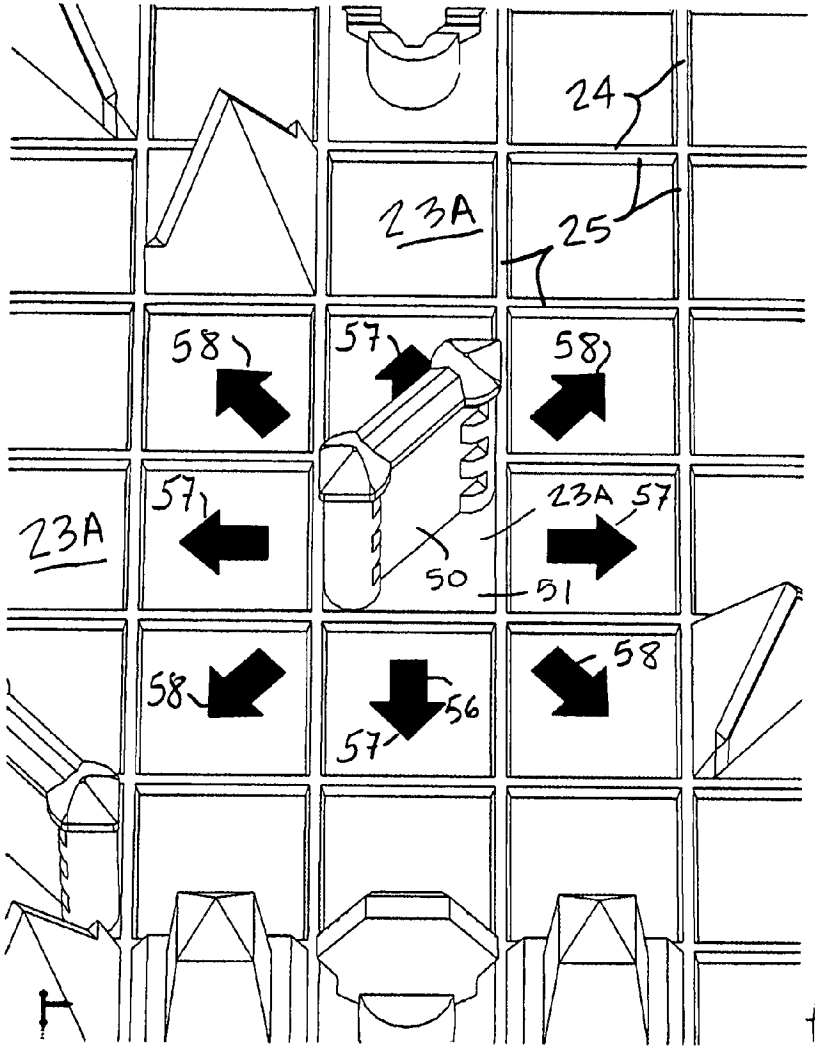
FIG. 15 is a partial perspective view of the preferred embodiment of the apparatus of the present invention illustrating a lateral movement of one of the game pieces to an adjoining or adjacent square.
Figure 16:
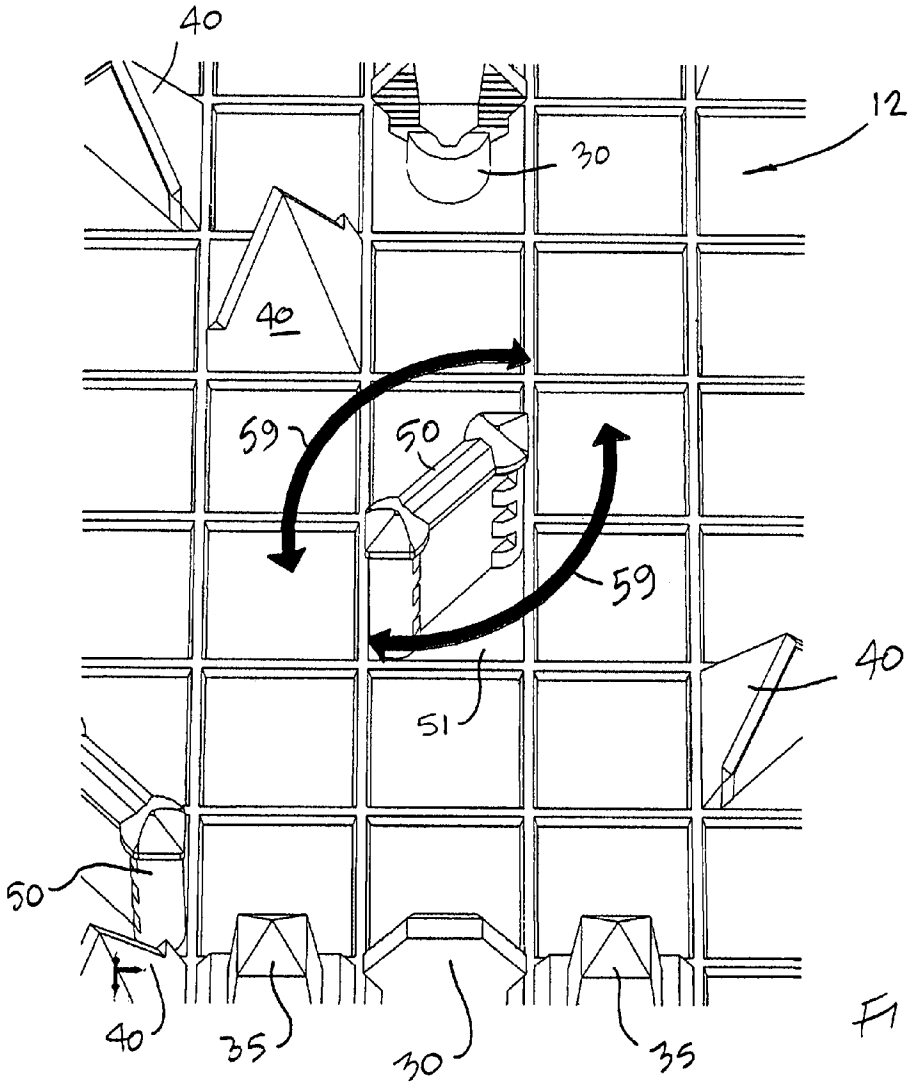
FIG. 16 is a partial perspective view of the preferred embodiment of the apparatus of the present invention illustrating a rotating move of one of the game pieces.

FIGS. 15 and 16 illustrate the moves that are available to a particular game piece 30, 40, 45, 50. In FIG. 15, the game piece 50 is shown occupying one of the recessed areas 23A. Arrows 57 illustrate that game piece 50 can more to an adjacent square in an orthogonal direction while arrows 58 indicate that game piece 50 can be moved diagonally as well to an adjacent space.

In FIG. 16, curved arrows 59 illustrate that game piece 50 can be rotated. A rotational move is important for one of the mirrored game pieces 40, 50 in that it changes the position of the mirror 45, 55, 56 relative to the beam 29 that is emitted by either of the lasers 21, 22 (see FIG. 17).

FIGS. 1 and 2 show the game board, containing laser fire buttons 19, 20 and lasers 21, 22 having apertures. Two sets of playing pieces are shown, one can be of a dark color (e.g. gold) and one can be light in color (e.g. silver). FIGS. 1 and 2 shown one possible configuration to start a game. The particular configuration and combination of pieces, i.e., Pharaohs 30, Obelisks 35, Pyramids 40, and Djed columns 50, shown works very well for beginners and seasoned players, creating a challenging scenario at the onset.

The rules for moving and taking turns work well for a wide variety of starting configurations, and it is anticipated that players may begin with any starting configuration for which there is mutual agreement.

Game board 11 can consist of a playing surface 23, with a recessed grid of rows and columns, and a bounding frame or border 15. Each of the squares 23A at the intersections of the rows and columns on the board surface are recessed so as to ensure proper alignment of playing pieces. Correspondingly, the bases 31, 36, 41, 51 of the pieces 30, 35, 40, 50, which fit into the recessed squares 23A have the same shape so as to ensure proper alignment.

Figure 21:
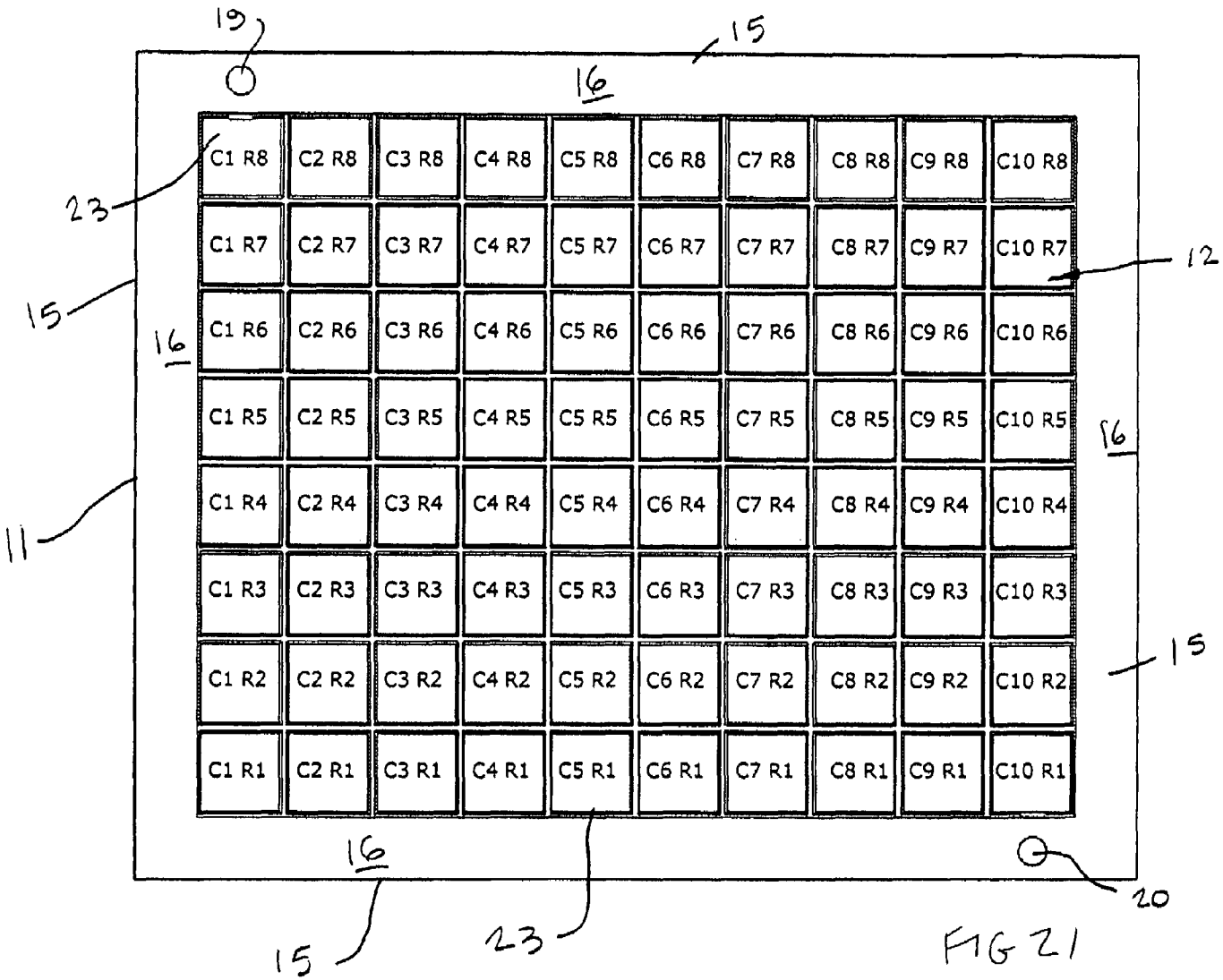
FIG. 21 is a schematic plan view of the game board portion of the preferred embodiment of the apparatus of the present invention and illustrating each square using a column and row number.

The raised border or frame 15 houses two laser diodes 21, 22, or any other collimated light source(s). If diodes 21, 22 are used, they will be of low power, being either class I, class II or class III lasers 21, 22. The light sources are oriented such that the beams 29 are parallel to the playing surface 23 or the floor of the game board 11 and are aligned with column 1 and column 10, as shown in FIG. 21. The raised border frame 15 also acts as a bounding surface to prevent the laser light beams 29 from extending beyond the boundaries of the game board, i.e., the beam 29 doesn't leave the confines of the playing surface 23.

In the preferred embodiment, the lasers 21, 22 are powered by a battery or batteries which are housed in a compartment(s) 27 in the frame cavity 26. Also contained in frame cavity 26 are the wires which make two parallel electrical connections, each making serial links between the batteries, a laser fire switch button 19, 20 and a laser diode 21, 22. The laser fire buttons switch can each be a normally open switch which activates the laser 21, 22 closest to it, for the duration the button 19, 20 is depressed. Once a button 19 or 20 is released, the laser is deactivated.

The game pieces 30, 35, 40, 50 can be made of translucent plastic so as to glow when stuck by the laser beam on any non-mirrored surface.

The game piece 30 (i.e. Pharaoh or key piece), have no mirrored surfaces. The loser of the game is the first to have his or her key game piece 30 (e.g. Pharaoh) illuminated by a light beam 29, which signifies the end of a game.

The game piece 40 possesses one surface which is a mirror 45 that reflects impinging laser light. Other surfaces of the piece 40 are non-mirrored. The mirror or mirrored surface 45 is oriented perpendicular to the base 41, and along a diagonal line which passes through opposite corners 47, 48 of the base 41. This mirror 45 orientation, coupled with the square base 41 seating into a recessed square 23A of the game board 11, ensures that when the piece 40 is in any space 23A that puts the mirrored surface in the path of a laser beam 29, the beam reflects at a right angle. This results in a change of the beam path in one of two ways, either (1) beams 29 traveling parallel to columns on the game board are reflected to be parallel to rows on the game board 11, or (2) beams 29 traveling parallel to rows are reflected to be parallel to columns. If the piece 40 is in any space that puts one of its non-mirrored surfaces in the path of a laser beam 29, the piece 40 is illuminated and removed from play at the end of a player's turn.

The double-mirrored piece 50 can be shaped as an Egyptian Djed column. The piece 50 has two surfaces 55, 56 which are mirrors to reflect impinging laser light. These mirrored surfaces 55, 56 may be totally reflective mirrors mounted back-to-back and oriented perpendicular to the base 51, and along a diagonal line which passes through opposite corners 60, 61 of the base 51 (see FIG. 14). The mirrored surfaces 55, 56 may be opposite sides of a single beam-splitting, partial mirror (also known as a "one-way mirror", "two-way mirror", or "beam-splitter".) This mirror surface orientation, coupled with the square base 51 seating into the recessed squares 23A of the game board 11, ensures that when the piece 50 is in any space 23A that puts it in the path of a laser beam 29, that all or part of the beam 29 reflects at a right angle. This results in a change of the beam path in one of two ways, either (1) beams 29 traveling parallel to columns are reflected to be parallel to rows, or (2) beams 29 traveling parallel to rows are reflected to be parallel to columns. When partial mirrors are used, a portion of the impinging beam will continue along its original path and will not be diverted, leading to the creation of two beams from a single light source. Since laser beams 29 impinging upon a double-mirrored Djed piece 50 will always strike a mirrored surface, these pieces are never illuminated and therefore never removed from play.

A turn can consist of a player moving one of his or her pieces 30, 35, 40, 50 to an adjacent, unoccupied square (see FIG. 15). One variation permits Djed Column pieces to move into adjacent squares which are occupied by either Obelisks 35 or Pyramids 40 belonging to either player. If this is done, the displaced piece is moved, retaining its rotational orientation, to the square which the Djed Column piece 50 vacates.

FIG. 16 illustrates that a player may rotate one of his or her pieces (such as game piece 50 shown) one-quarter turn (i.e., 90 degrees) either clockwise or counter-clockwise (see arrows 57).

Figure 17:
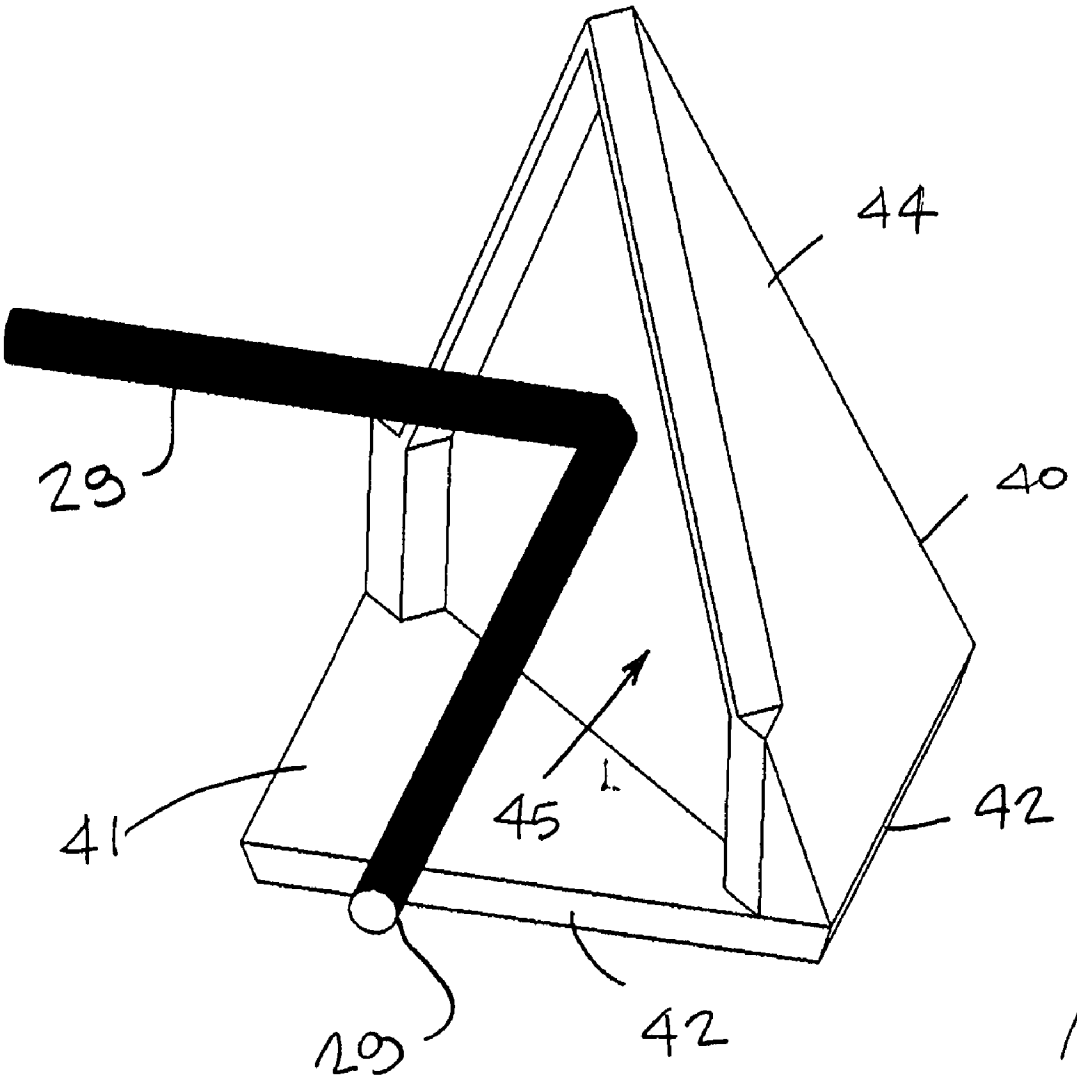
FIG. 17 is a partial perspective view of the preferred embodiment of the apparatus of the present invention illustrating a mirrored game piece reflecting a laser transmission.

FIG. 17 shows a laser beam 29 reflecting off surface 45 of game piece 40 (e.g. a Pyramid in this case).

Figure 18:
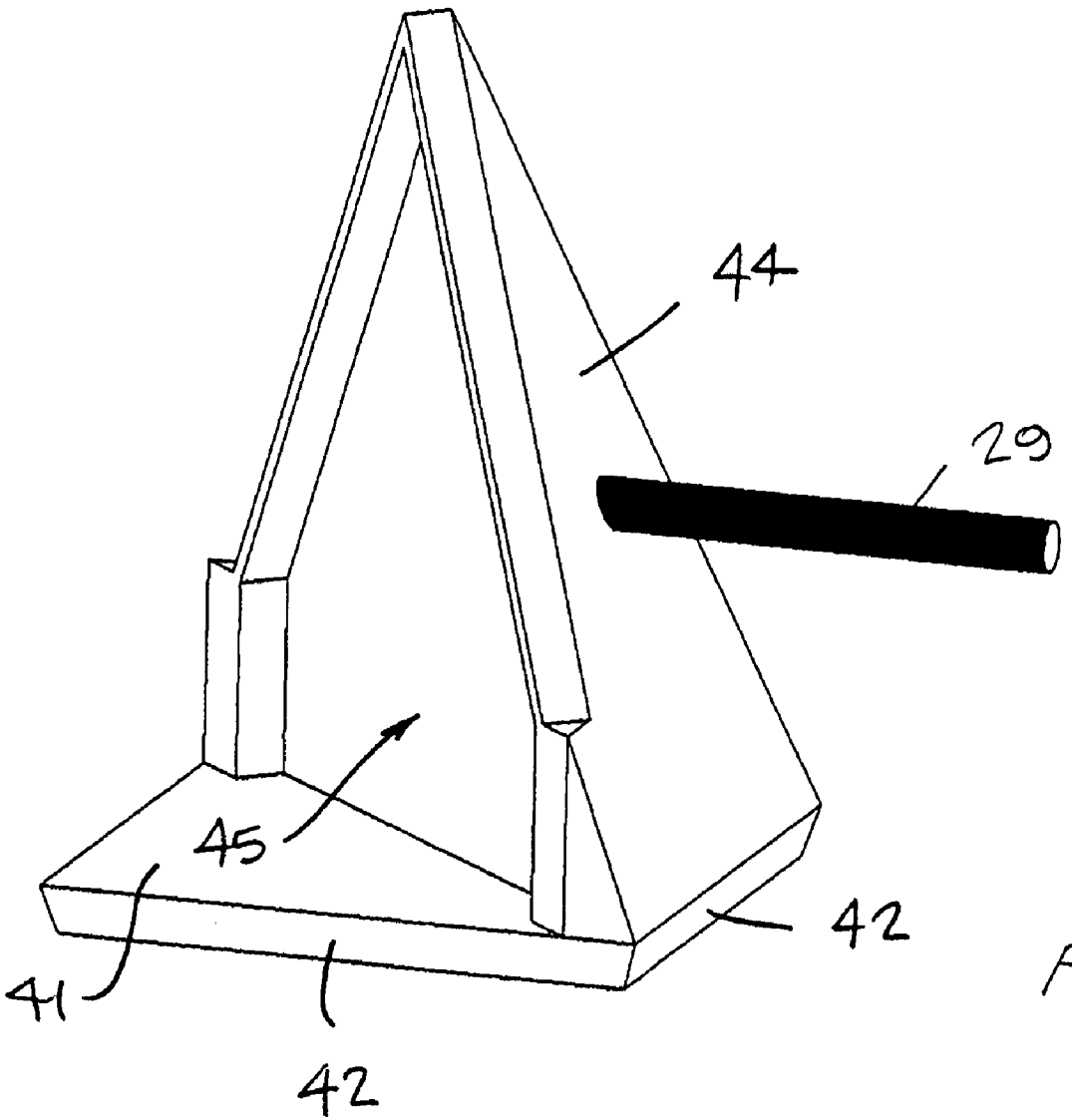
FIG. 18 is a partial perspective view of the preferred embodiment of the apparatus of the present invention illustrating a mirrored game piece receiving the laser beam on a non-mirrored surface.

FIG. 18 shows a laser beam 29 terminating on a non-mirrored surface of a typical piece 40 (a Pyramid in this case). This game piece 40 would be removed from play in this illustration of FIG. 18.

Figure 19:
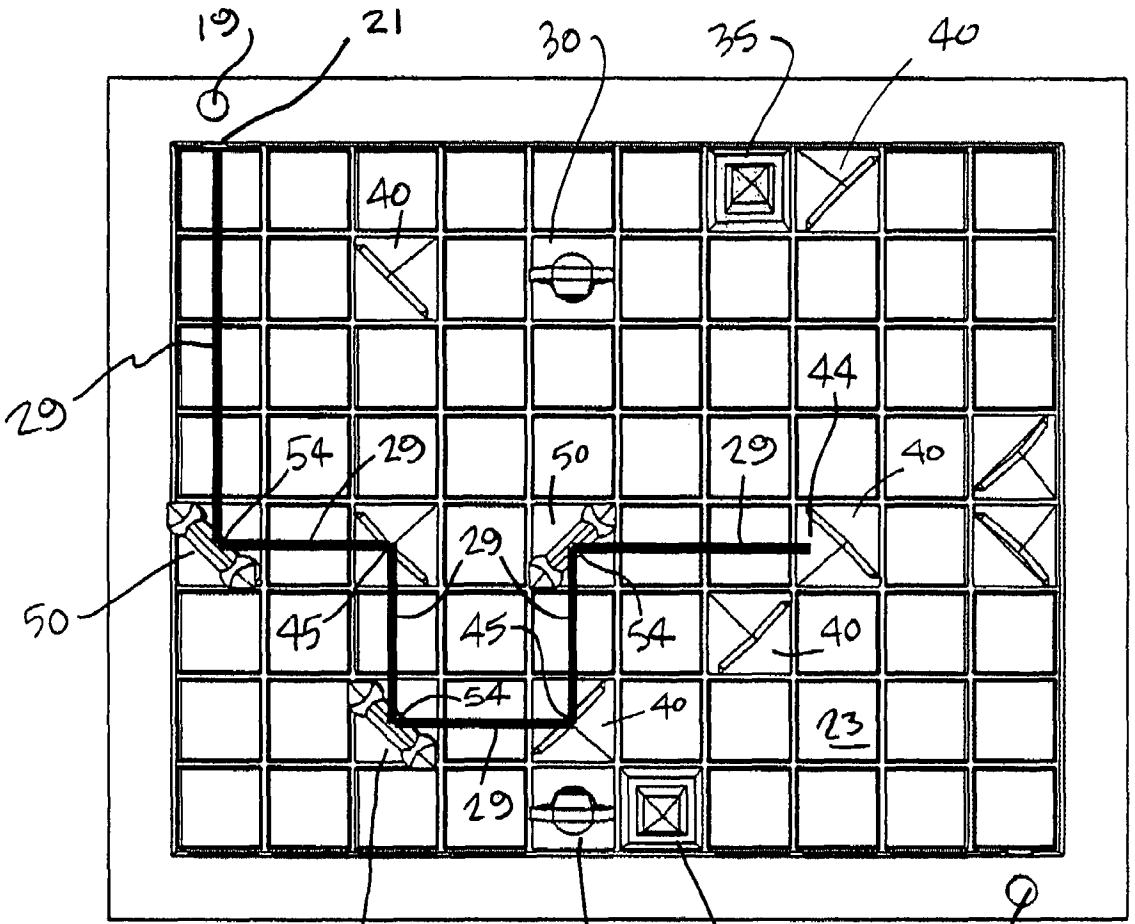
FIG. 19 is a partial plan view of the preferred embodiment of the apparatus of the present invention illustrating a transmission of the laser beam to multiple mirrored game pieces and then to a non-mirrored surface of a game piece resulting in removal of that game piece.

FIG. 19 shows a top view of the game board 11 with a possible configuration of pieces 30, 35, 40, 50 to represent a game in-progress. A heavy line represents a laser beam 29 which reflects from multiple mirrored surfaces on five pieces 50, 40, 50, 40, 50 before terminating on the non-mirrored surface of the key game piece 40 (e.g. a Pyramid), which would be removed from the game board at the end of this turn.

Figure 20:
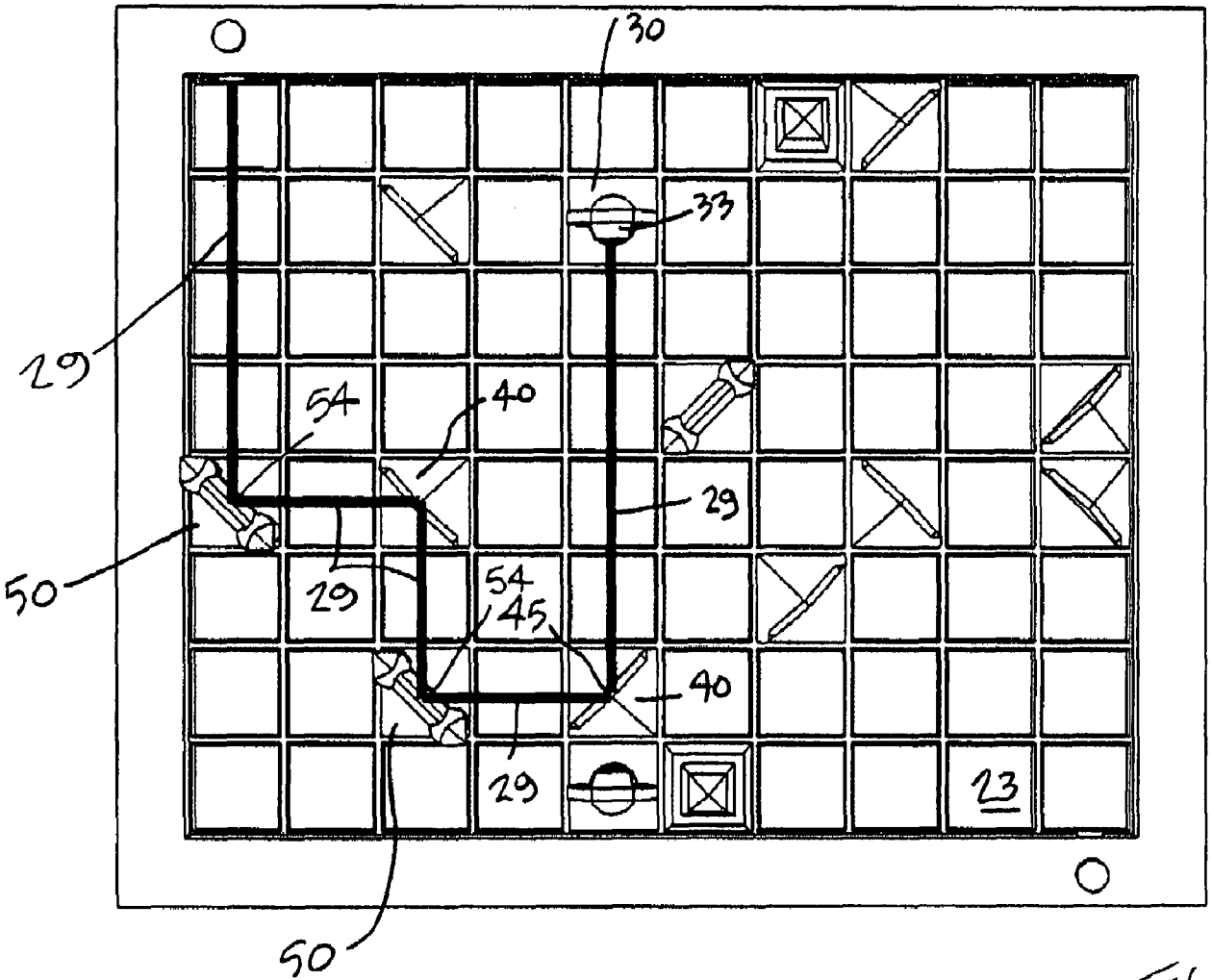
FIG. 20 is a plan view of the preferred embodiment of the apparatus of the present invention illustrating transmission of the laser to multiple mirrored game pieces and to the non-mirrored key game piece ending the game.

FIG. 20 shows a top view of the game board 11 with a possible configuration of pieces to represent a game in-progress. The heavy line represents a laser beam 29 which reflects from four mirrored surfaces on four pieces 50, 40, 50, 40 before terminating on the non-mirrored surface of key game piece 30 (e.g. a Pharaoh). Such a situation would mark the end of the game. The player whose key game piece 30 (e.g. Pharaoh) was hit by the beam is the loser.

FIG. 21 shows a numbering scheme for the rows and columns of the game board 11, for the purpose of aiding the description of play. While a specific composition of pieces comprising each set, along with a specific starting configuration, is discussed below, it is important to note that the pieces composing each set at the beginning of the game can be any number and combination of types agreed upon by the two contestants, as long as there is one Pharaoh (key piece) each. Likewise, at the start of a game, the pieces can be arranged in any agreed upon configuration, as long as the placements of pieces in each player's set has the same arrangement when viewed from one side of the board as the arrangement of the opponent's pieces has when viewed from the opposite side of the board. (This arrangement holds true in traditional chess, with the exception of the placement of the king and queen, which are symmetric about the chess board's midline running between the two starting positions, i.e., white has the king on the right of the queen, while black has the queen on the left of the king.)

Assuming the two colors used to differentiate the players' sets of pieces are gold and silver, the following table provides a guide to the starting positions for those players' pieces. This configuration is shown in a perspective view in FIG. 1 and in a top view in FIG. 2. The square designations for column and rows are given in FIG. 21. For this specified arrangement, the gold-player's laser fire button is the one closest to the C10R1 square, while the silver-player's button is closest to the C1R8 square.

| Player | Piece type | Quantity | Starting location specified in FIG. 10 by column and row numbers. When applicable, mirror surface is toward corner designated by A, B, C or D. | | | | | | |
|---|---|---|---|---|---|---|---|---|---|
| gold | Pharaoh | 1 | C5R1 | | | | | | |
| gold | Obelisk | 2 | C4R1 | C6R1 | | | | | |
| gold | Pyramid | 7 | C3R1 D | C8R2 C | C3R4 D | C10R 4 A | C3R5 A | C10R 5 D | C4R 6 D |
| gold | Djed Column | 2 | C5R4 D | C6R4 C | | | | | |
| silver | Pharaoh | 1 | C6R8 | | | | | | |
| silver | Obelisk | 2 | C5R8 | C7R8 | | | | | |
| silver | Pyramid | 7 | C7R3 B | C1R4 B | C8R4 C | C1R5 B | C8R5 C | C3R7 A | C8R 8 B |
| silver | Djed Column | 2 | C5R5 C | C6R5 D | | | | | |

Players alternate turns. A turn consists of a player moving one of his pieces (all the pieces move in the same way, unlike in chess where each piece type is governed by a different rule for moving) either: (1) to one of the potentially eight squares which are contiguous to the presently occupied square, forward, backward, left, right, or diagonally, as long as the new square is unoccupied, while preserving the orientation of the piece, or (2) by a clockwise or counter-clockwise quarter turn (i.e., ±90 degrees about the vertical centerline of the piece) while remaining in the presently occupied space. (There will be fewer than eight spaces available to pieces located at the periphery of the playing board.) The pieces may not, however, occupy a space in the column which corresponds to the opponent's laser location, e.g., for the starting configuration of FIGS. 1, 2 and using the space and corner designations of FIG. 21 with the silver player operating the laser button 19 and the gold player operating the laser button 20. Silver pieces are not permitted to occupy any space in column 10 and gold pieces are not permitted to occupy any space in column 1.

After a player moves a piece, he presses his laser fire button 19 or 20. Any piece 30, 35, 40, 50 which is illuminated on a non-mirrored surface is removed from the board, no matter to which player the piece belongs, and the turn shifts to the other player (opponent).

PARTS LIST

The following is a list of parts and materials suitable for use in the present invention:

| Parts Number | Description |
|---|---|
| 10 | laser game board apparatus |
| 11 | game board |
| 12 | upper surface |
| 13 | lower surface |
| 14 | periphery |
| 15 | raised border |
| 16 | horizontal section |
| 17 | outer vertical section |
| 18 | inner vertical section |
| 19 | laser activating button |
| 21 | laser activating button |
| 22 | laser |
| 23 | playing area |
| 23A | recessed square surface area |
| 24 | raised element |
| 25 | raised square border |
| 26 | cavity |
| 27 | battery compartment |
| 28 | wiring |
| 29 | laser beam |
| 30 | key game piece |
| 31 | base |
| 32 | periphery |
| 33 | vertically extending portion |
| 34 | underside |
| 35 | game piece |
| 36 | base |
| 37 | periphery |
| 38 | vertically extending portion |
| 39 | underside |
| 40 | game piece |
| 41 | base |
| 42 | periphery |
| 43 | underside |
| 44 | vertically extending portion |
| 45 | mirrored surface |
| 46 | angle |
| 47 | corner |
| 48 | corner |
| 49 | reference line |
| 50 | game piece |
| 51 | base |
| 52 | underside |
| 53 | periphery |
| 54 | vertically extended portion |
| 55 | mirrored surface |
| 56 | mirrored surface |
| 57 | orthogonal arrow |
| 58 | diagonal arrow |

-continued

| Parts Number | Description |
|---|---|
| 59 | curved arrow |
| 60 | corner |
| 61 | corner |
| 62 | corner |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A board game, comprising:

a game board having a playing surface and a cavity for holding electronic components;

a plurality of game pieces, each having a base with a periphery and an under surface;

the playing surface being segmented into a plurality of spaces, each defining a location that can be occupied by one of the game pieces;

a first beam emitting device mounted to the game board;

a second beam emitting device mounted to the game board;

a first control button that enables a first player to activate and deactivate the first beam emitting device;

a second control button that enables a second and opposing player to activate and deactivate the second beam emitting device;

mirrored surfaces being provided upon multiple of the game pieces, some of the pieces having more than one mirrored surface; and the game pieces, spaces and beam emitting devices being so configured that when a beam emitted by the beam emitting device strikes a mirrored surface on a game piece that occupies a space, the beam reflects along a line that traverses one or more other spaces.

2. The board game of claim 1 wherein the beam emitting devices are each laser diodes.

3. The board game of claim 1 wherein one of the game pieces is a key game piece that enables a game to be ended when a beam strikes the key piece of one of the players.

4. The board game of claim 3 wherein the key game piece is non-mirrored.

5. The board game of claim 1 wherein there are two key game pieces, enabling a key game piece to be associated with each of two opposing game players.

6. The board game of claim 5 wherein the key game pieces are non-mirrored.

7. The board game of claim 1 wherein each of the spaces is recessed.

8. The board game of claim 7 wherein each game piece has a base that is sized and shaped to fit a recessed space.

9. The board game of claim 1 wherein each of the spaces is surrounded by a raised border.

10. The board game of claim 9 wherein each game piece has a base that is sized and shaped to fit inside the raised border of a space.

11. The board game of claim 1 wherein some of the mirrored pieces have a mirror that forms an angle of about 45 degrees with the beam emitted by a beam emitting device.

12. The board game of claim 1 wherein at least one mirror has a surface that reflects a beam emitted by the beam emitting device an angle of about 90 degrees when the game piece occupies a space traversed by a beam emitted by a beam emitting device.

13. The board game of claim 1 wherein the beam control buttons are positioned on opposite sides of the game board.

14. The board game of claim 1 wherein the game board has a raised periphery that disallows transmission of a beam beyond the periphery of the game board.

15. A game comprising:

a game board having a playing surface and one or more receptacles for holding electronic components;

a plurality of game pieces, each having a base with a periphery and an under surface, some of the game pieces being mirrored and some of the game pieces being non-mirrored;

the playing surface being segmented into a plurality of spaces, each defining a location that can be occupied by one of the game pieces;

one of the electronic components being a first beam emitting device mounted to the game board;

another electronic component being a second beam emitting device mounted to the game board;

a first control button that activates and deactivates the first beam emitting device;

a second control button that activates and deactivates the second beam emitting device;

the game pieces, spaces and beam emitting devices being so configured that when a beam emitted by the beam emitting device strikes a mirrored surface on a game piece that occupies a space, the beam reflects along a line that traverses one or more other spaces.

16. The game of claim 15 wherein the beam emitting devices are each laser diodes.

17. The game of claim 16 wherein the spaces are arranged in a matrix of rows and columns.

18. The game of claim 15 wherein there are two key game pieces, enabling a key game piece to be associated with each of two opposing game players.

19. The game of claim 15 each of the spaces is surrounded by a raised border.

20. The game of claim 15 wherein some of the mirrored pieces have a mirror that forms an angle of about 45 degrees with the beam emitted by a beam emitting device.

21. The game of claim 15 wherein at least one mirror has a surface that reflects a beam emitted by the beam emitting device an angle of about 90 degrees when the game piece occupies a space traversed by a beam emitted by a beam emitting device.

22. The game of claim 15 wherein each space is recessed and each game piece has a base that is sized and shaped to fit inside the recessed space.

23. The game of claim 15 wherein the game has a raised periphery that disallows transmission of a beam beyond the periphery of the game board.

24. The game of claim 15 wherein the spaces are arranged in a matrix.

25. A laser game comprising:

a game having a playing surface and a cavity for holding electronic components;

a plurality of game pieces, each having a base with a periphery and an under surface, some of the game pieces being mirrored and some of the game pieces being non-mirrored;

the playing surface being segmented into a plurality of rows and columns defining spaces at the intersection of each row and column, each space defining a location that can be occupied by one of the game pieces;

a first beam emitting device mounted to the game board;

a second beam emitting device mounted to the game board;

a first control button that activates and deactivates the first beam emitting device;

a second control button that activates and deactivates the second beam emitting device;

the beam emitting devices being mounted to emit a beam along a column and the spaces being positioned so that when a beam emitted by the beam emitting device strikes a mirrored surface on a game piece that occupies a space, the beam reflects along a line that traverses one or more of the space of a row.

26. The laser game apparatus of claim 25 wherein each space provides a recess that is receptive of a game piece.

27. The laser game of claim 26 wherein some of the game pieces have multiple surfaces that are mirrored.

28. The laser game of claim 25 wherein there are two sets of game pieces.

29. The laser game of claim 25 wherein some of the game pieces have multiple surfaces that are mirrored.

30. The laser game of claim 25 further comprising a raised peripheral border and wherein each beam emitting device is positioned to emit a beam along a line that extends between the beam emitting device and the border.

31. A board game for two opposing players or teams of players comprising:

a game board, movable playing pieces having at least one mirrored surface, movable key playing pieces having no mirrored surfaces, and a laser source, wherein alternate turns are taken to move playing pieces for the purpose of deflecting laser beams, so as to illuminate the key playing piece of the opponent.

32. The board game of claim 31, wherein pieces can be positioned to prevent the opponent from illuminating the key playing piece.

33. The board game of claim 31, wherein the pieces can be positioned in recesses on the board to ensure reflection of the laser beam.

34. The board game of claim 31, comprising:

a checkerboard-style game board having first and second ends, a pair of opposed sides, and a playing surface comprising a plurality of spaces to form a checkerboard pattern, said spaces forming a plurality of columns extending between said sides, and a plurality of rows extending between said ends;

two sets of game pieces, comprising at least one piece without a mirrored surface, and at least one piece possessing at least a single mirror surface;

said game pieces having initial locations in respective spaces on said game board; and a board which houses two or more laser diodes.

35. The board game of claim 31, comprising:

a checkerboard-style game having first and second ends, a pair of opposed sides, and a playing surface comprising a plurality of spaces to form a checkerboard pattern, said spaces forming a plurality of rows extending between said sides, and a plurality of columns extending between said ends;

two sets of game pieces comprising one Pharaoh, two Obelisks, seven Pyramids, and two Djeds;

and two laser diodes.

36. The board game of claim 35, wherein the game includes eight rows.

37. The board game of claim 35, wherein the game includes ten columns.

38. The board game of claim 35, wherein the game includes eighty squares.

39. A method of playing a game by opposed players; said game comprising two sets of distinguishable playing pieces, each set having movable pieces with no mirrored surfaces, of which one is a key piece, and pieces with at least one mirrored surface, a game board consisting of a first end, a second end, and a plurality of rows and columns, intersecting to form a plurality of spaces, the method comprising the steps of:

placing each player's set of playing pieces on the game in a pre-determined starting configuration; and alternating turns, each turn comprising moving, either a translation or a rotation, a piece followed by activation of a laser, said alternating moves continuing until one player illuminates the opposing player's key piece;

wherein moving a piece consists of a movement one space in a horizontal, vertical, or diagonal direction to an unoccupied adjacent space.

40. A method of playing a game by opposed players, said game comprising two sets of distinguishable playing pieces, each set having movable pieces with no mirrored surfaces, of which one is a key piece, and pieces with at least one mirrored surface; and a game board consisting of a first end, a second end, and a plurality of rows and columns intersecting to form a plurality of spaces, the method comprising the steps of:

placing each player's set of playing pieces on the game in a pre-determined starting configuration; and alternating turns, each turn comprising moving, either a translation or a rotation, a piece followed by activation of a laser, said alternating moves continuing until one player illuminates the opposing player's key piece;

wherein moving a piece consists of a movement one space in a horizontal, vertical, or diagonal direction to an available adjacent square, or of remaining in the same space and rotating the piece.

41. A board game for multiple opposing players or teams of players, comprising:

a game board, movable playing pieces having at least one mirrored surface, movable key playing pieces having no mirrored surfaces, and a laser source, wherein alternate turns are taken to move playing pieces for the purpose of deflecting laser beams, so as to illuminate the key playing piece of the opponent.

42. The board game of claim 41, wherein multiple, horizontal playing surfaces are parallel and arranged in a vertically-stacked arrangement.

43. The board game of claim 41, wherein pieces reflect the light at a 90 degree angle while keeping the laser beam parallel to the playing surface.

44. The board game of claim 41, wherein pieces reflect the laser beam at an arbitrary and/or adjustable angle while keeping the laser beam parallel to the playing surface.

45. The board game of claim 43, wherein pieces reflect the laser beam at an angle to reflect the laser beam from one game board level to another.

46. The board game of claim 41, wherein pieces can split an incident laser beam into multiple laser beams.

47. The board game of claim 41, wherein pieces allow an incident laser beam to pass through from one direction while reflecting a laser beam from another.

48. The board game of claim 41, wherein pieces illuminate when in the path of a laser beam.

49. The board game of claim 41, wherein pieces are moveable and emit laser beams.

50. The board game of claim 41, wherein pieces have multiple component parts.

51. The board game of claim 41 further comprising means for visually revealing the path of the laser beams.

52. The board game of claim 41, wherein the and pieces magnetically attract.

53. The board game of claim 41, wherein switches control the illumination of the laser beam sources.

54. The board game of claim 41, wherein a sound is generated when the key playing piece is illuminated.

* * * * *